United States Patent [19]

Gutzwiller

[11] 4,318,693

[45] Mar. 9, 1982

[54] AXIAL FAN TURNING DIFFUSER

[75] Inventor: Howard L. Gutzwiller, Zelienople, Pa.

[73] Assignee: Robinson Industries, Inc., Zelienople, Pa.

[21] Appl. No.: 208,590

[22] Filed: Nov. 20, 1980

[51] Int. Cl.[3] ..... F27B 5/16

[52] U.S. Cl. ..... 432/201; 415/182; 415/206; 415/207; 432/203

[58] Field of Search ..... 432/199, 201, 203, 254.2; 415/182, 206, 207

[56] References Cited

U.S. PATENT DOCUMENTS

| | | | |
|---|---|---|---|
| 1,940,948 | 12/1933 | Harsch | 433/199 |
| 2,039,429 | 5/1936 | Lydon | 432/203 |
| 2,169,232 | 8/1939 | Flanders | 415/207 |
| 2,538,739 | 1/1951 | Troller | 415/207 |
| 3,446,428 | 5/1969 | White | 415/207 |
| 4,219,325 | 8/1980 | Gutzwiller | 417/373 X |

*Primary Examiner*—John J. Camby

*Attorney, Agent, or Firm*—Webb, Burden, Robinson & Webb

[57] ABSTRACT

The axial fluid flow fan comprises a shaft, an impeller mounted on said shaft comprising a tankhead and a plurality of blades, a drive means attached to the shaft for rotating the impeller and a deflector having a bugle bell shape defined by a small diameter, a large diameter and a radius of curvature joining the diameters. The deflector is positioned downstream of the fan and slightly spaced from the impeller to separate the fluid coming off the impeller into at least two annular flow areas. The fan is part of a plug unit for a heat treating furnace in which the deflector is positioned about a frustoconical shaped shield which protects the shaft. The flow area downstream of the impeller is divided into equal areas. An extension plate in the furnace cooperates with the deflector to maintain the split areas of flow.

8 Claims, 5 Drawing Figures

AXIAL FAN TURNING DIFFUSER

FIELD OF THE INVENTION

My invention relates to axial flow fans and in particular to those fans adapted for use as plug units in high temperature environments such as heat treating furnaces.

DESCRIPTION OF THE PRIOR ART

Axial fans, both unidirectional and reversible, have been used in plug units in high temperature environments such as heat treating furnaces. One such plug unit is described in my U.S. Pat. No. 4,219,325. In such an application it is necessary to move the air, gas and/or products of combustion (cumulatively referred to hereinafter as fluid, gas or air) about a large furnace chamber to provide uniform heating to articles being treated. The objective is to achieve a high flow rate and high velocities at relatively low horsepower.

It is also recognized that the exit velocity from an impeller is greatest at the tip of the blades and decreases radially inward toward the hub or tankhead of the impeller. At high rotating speeds (rpm) this can create an air curtain at the blade tips through which other air must pass during circulation. Where rapid and efficient circulation is required, this air curtain (or effect which approaches an air curtain) inhibits proper circulation thereby requiring greater horsepower to achieve the necessary velocities and flow volumes for proper heat treating.

SUMMARY OF THE INVENTION

My invention separates the air coming off the fan blades into annular flow areas which are generally equal. This allows the air leaving the blades near the tankhead to flow more freely without being disturbed or inhibited by the air coming off the blades near the blade tips. The effect is a smooth air flow which results in a higher flow rate, higher static pressure, lower horsepower and higher efficiency. This results in higher volume flow rates through the furnace with accompanying higher gas velocities past the articles being treated which in turn provide a higher rate of heat transfer and a shorter cycle time to complete the heat treating. My axial fluid flow fan comprises a shaft, an impeller mounted on the shaft including a tankhead and a plurality of blades, a drive means attached to the shaft and a deflector having a bugle bell shape defined by a small diameter, a large diameter and a radius of curvature joining the diameters. The fan is mounted in a plug unit for a heat treating furnace with the deflector being coaxially positioned about a housing which protects the shaft so as to separate the air passing through the fan into equal flow areas. An extension in the furnace coacts with the deflector to maintain the separate flow areas and direct the air in the desired manner.

DESCRIPTION OF THE PREFERRED EMBODIMENT

Figure 1:
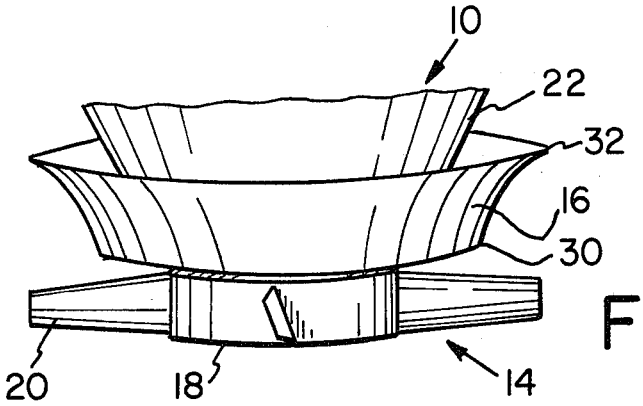
FIG. 1 is a perspective view showing my axial flow fan plug unit.
Figure 2:
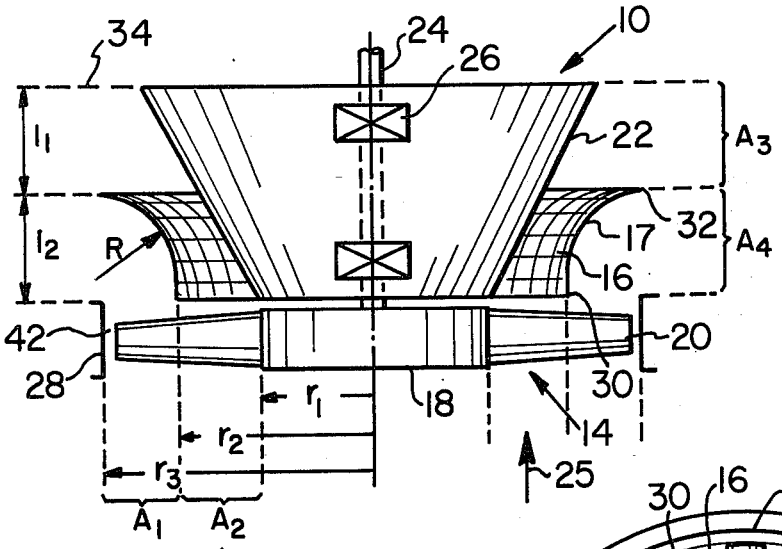
FIG. 2 is a side elevation of my axial flow fan plug unit.
Figure 3:
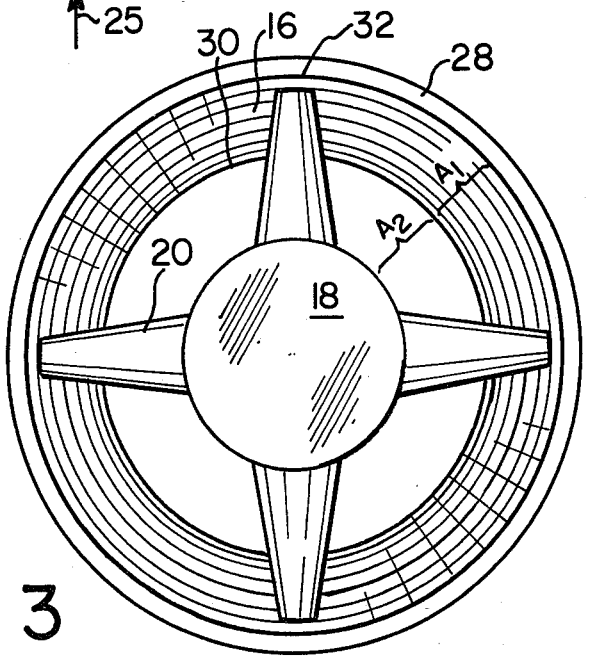
FIG. 3 is an end elevation or bottom view of the plug unit.
Figure 4:
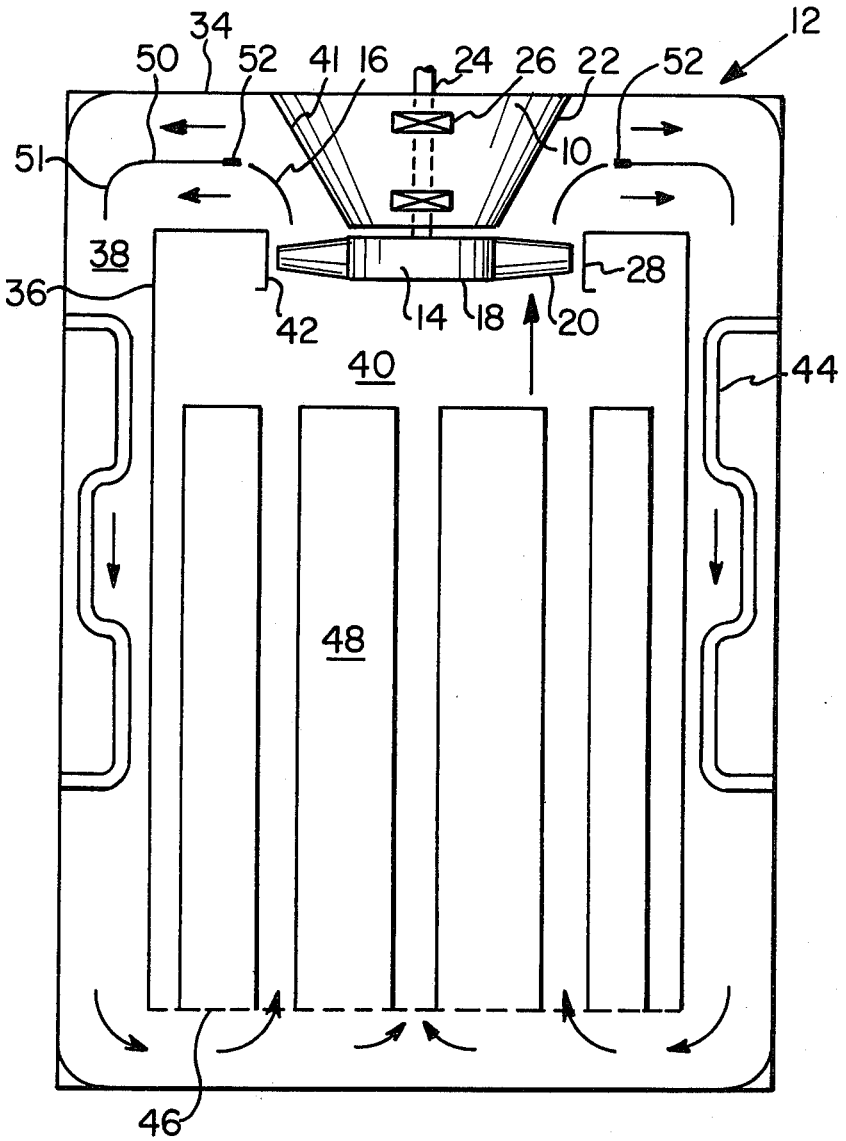
FIG. 4 is a schematic illustration of my plug unit in a heat treating furnace.

My plug unit, generally designated 10, FIGS. 1–3, is intended for installation in a heat treating furnace 12, FIG. 4, of the type where articles 48 are treated by high volumes of gases passing over the articles 48 to effect the appropriate heat transfer.

My plug unit 10 includes an impeller 14 which in the preferred embodiment is a recirculating axial flow fan positioned inside the furnace 12. Impeller 14 includes a plurality (4 or more) of blades 20 connected to a tankhead 18 which in turn is connected to a shaft 24 driven by an appropriate motor (not shown). Bearings 26 surround the shaft 24 in the standard manner, FIG. 2. The shaft 24 and bearings 26 are protected by a frustoconical shaped insulated shield 22.

A deflector 16 having a bugle bell shape is positioned about the shield 22 adjacent the impeller 14. The deflector 16 is secured to the shield 22 by means of appropriate framing such as a tripartite yoke (not shown). It will be recognized that the deflector 16 may likewise be secured in a similar manner to other components of the plug unit which are not shown. The deflector 16 includes a first deflector end 30 defining a minor diameter which is positioned substantially adjacent to the impeller blades 20. The opposing or second deflector end 32 which defines the major diameter of the deflector 16 is positioned about the shield 22 downstream of the first deflector end 30. The deflector wall 17 is defined by a radius of curvature R which initiates at the minor diameter 30 and becomes tangent to the major diameter 32, FIG. 2.

The deflector 16 is so dimensioned as to provide two annular and equal flow areas coming off the fan blades as well as off of the deflector 16. The principle direction of air flow is shown by arrows 25, FIG. 2, however, the air flow may be in the opposite direction or alternatively in both directions (reversible service).

the radius $r_1$ of the tankhead 18 is substantially equal to the radius of the terminal or small diameter end of the frustoconical shield 22. The impeller 14 is positioned in an opening 42 of a furnace shroud 28 as will be described in more detail hereinafter. The minor diameter 30 of the deflector 16 is dimensioned so that the flow area between the shroud 28 and the tankhead 18 is divided into two equal annular areas $A_1$ and $A_2$, FIGS. 2 and 3. This is readily determinable by taking the radius $r_3$ wich is the distance from the center line of the tankhead to the shroud and calculating the distance $r_2$ which is equal to the square root of $$\frac{r_3^2 + r_1^2}{2}.$$

The flow area downstream of the deflector 16 is likewise divided into two equal flow areas $A_3$ and $A_4$. Since in a typical application the total flow area is within a chamber of duct defined by the shroud 42 and the furnace wall 34, it is of rectangular cross sectional area so that the distance $l_1$ between the furnace wall 34 and the major diameter 32 of deflector 16 is equal to the distance $l_2$, which is the distance from the major diameter 32 of deflector 16 to the shroud 28, see FIGS. 2 and 4.

The radius R of shield wall 17 becomes tangent to an imaginary plane which bisects the distance between the shroud 28 and the furnace wall 34. The exact magnitude of R depends on a particular installation. However, it has to be large enough that there is no excessive restriction between the deflector 16 and the shield 22 and small enough that there is no excessive restriction between the deflector 16 and the shroud 28.

The application of the plug unit 10 is illustrated in a furnace 12 in FIG. 4. Furnace 12 comprises an outer furnace wall 34 and an inner shroud 36 so as to define an outer chamber 38 therebetween and an inner furnace chamber 40. Outer chamber 38 extends about the inner chamber 40 and houses the appropriate heating source such as radiant tubes 44. An opening 41 extends through the furnace wall 34 to accommodate the plug unit 10 and more particularly the shield 22.

The inner furnace wall 36 defines the furnace chamber 40 which accommodates the articles to be treated such as metal coils 48. The furnace floor 46 is perforated to permit the gases to pass from the outer chamber 38 into the inner chamber 40 in heat transfer relationship to the coils 48.

The deflector 16 effectively divides the air flow into two equal areas. In order to maintain that separation and further enhance the desired air flow, an extension plate 50 is built in as part of the furnace. Extension plate 50 is mounted within outer chamber 38 and adjacent to the major diameter end 32 of deflector 16. In the embodiment illustrated, the heating tube plenum (outer chamber 38) takes a 90° turn at each corner of the furnace. The extension plate 50 terminates in a curved portion 51 which bends about the upper corners and maintains the completely separate flow channels extending from the discharge of the impeller 14 around those corners and toward the area of the heating tubes 44. This results in higher volume flow rates through the furnace with accompanying higher gas velocities past the coils 48 and results in a higher rate of heat transfer and a shorter cycle time to complete heat treating. It has also been found that where the fan is of the reversible type, the deflector does not cause adverse effects when the air flow is reversed and the deflector then is in an upstream position.

Figure 5:
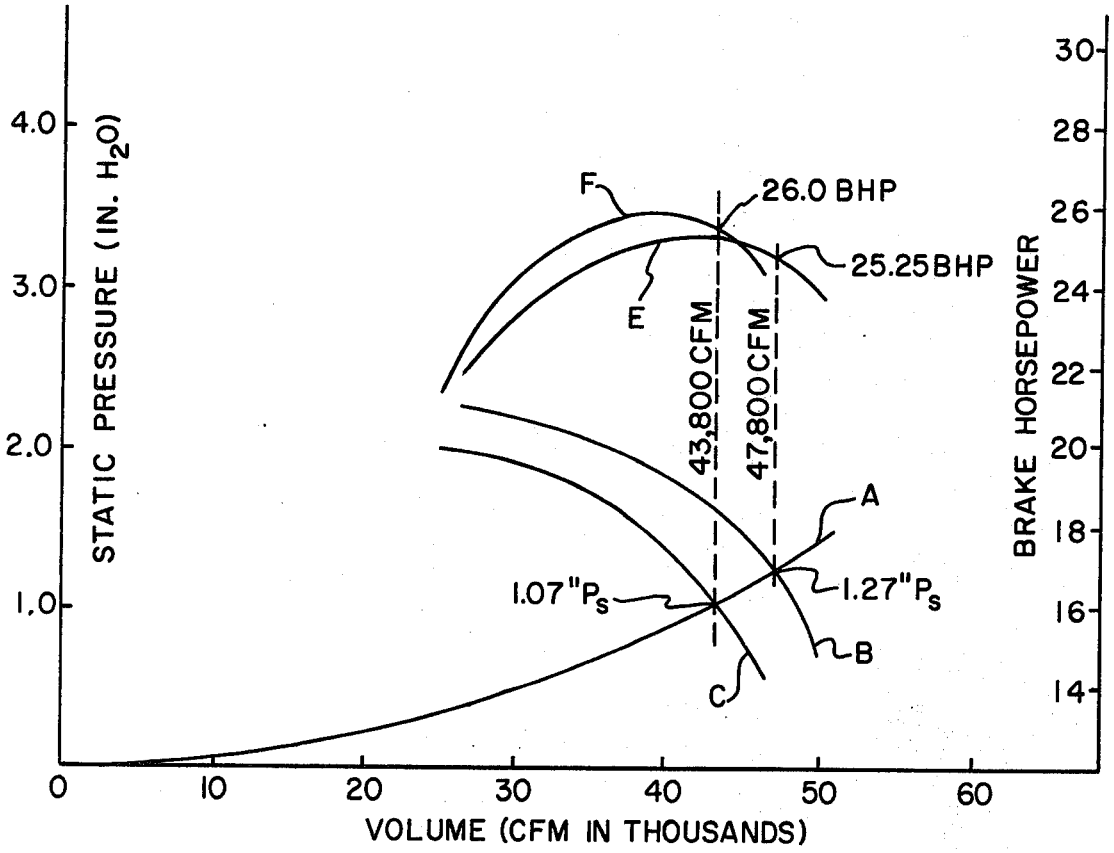
FIG. 5 is a series of curves showing the performance of my plug unit in comparison to a plug unit without the deflector.

The quantitative effect of the deflector 16 is illustrated in FIG. 5 where a 49 inch diameter fan operating at 1000 rpm and an air density of 0.075 lbs./cu. ft. was tested with and without such a deflector in accordance with A.M.C.A. test procedure 210-74. The duct system volume flow in thousands is depicted on the absicca and the static pressure in inches of water is depicted on one ordinant and the brake horsepower on the other. The system resistance curve is illustrated at A. The fan performance curve for the static pressure is illustrated at curves B and C for conditions with and without the deflector, respectively. The brake horsepower performance curve is depicted at curves E and F for a fan with and without the deflector, respectively. The point of intersection of the system curve A and the fan performance curves B and C determine the actual flow volumes. It can be seen that a fan with the deflector gives a greater volume and static pressure than the same fan without the deflector. Likewise, it can be seen that the brake horsepower developed is appreciably less for a fan with the deflector as compared to the fan without the deflector for a particular system resistance.

The static efficiency ($E_s$) of each of the pressure curves can be calculated as follows.

Without Deflector:

$$E_s = \frac{(43{,}800)\,(1.07)}{(26.0)\,(6362)} \times 100\% = 28.3\%$$

With Deflector:

$$E_s = \frac{(47{,}800)\,(1.27)}{(25.25)\,(6362)} \times 100\% = 37.8\%$$

The overall change in static efficiency is 9.5% or an increase of 33.6%, i.e., $$\left(\frac{37.8 - 28.3}{28.3} \times 100\right).$$

I claim:

1. An axial flow fan plug unit and heat treating furnace combination comprising:

A. an outer furnace wall having an opening therethrough;

B. an inner shroud having an opening therethrough defining a multi-sided outer chamber with the furnace wall and an inner chamber internal of the shroud for accommodating articles to be heat treated;

C. heating units positioned in the outer chamber;

D. a frustoconical shaped housing extending through the furnace wall opening to the inner shroud opening;

E. a driver shaft extending coaxial of the housing;

F. a tankhead connected to the end of the shaft;

G. a plurality of blades extending radially outward from the tankhead within the area of the inner shroud opening; and H. a bugle bell shaped deflector having a wall deflector positioned concentrically about the housing wherein the deflector wall is defined by a radius of curvature which initiates at a first end adjacent the blades and defining a minor diameter and which terminates at a second end defining a major diameter, said deflector wall at the second end terminating tangent to an imaginary plane bisecting the outer chamber, and wherein said minor diameter is equal to twice the square root of $(r_1^2+r_3^2)/2$, wherein $r_1$ is the tankhead radius and $r_3$ is the shroud opening radius, whereby the air curtain formed by the rotating blades is reduced and the effeciency of the fan is increased.

2. The combination of claim 1 including an annular extension plate positioned along the imaginary plane from the second end to divide a portion of the outer chamber into equal fluid movement areas.

3. The combination of claim 2 wherein the extension plate terminates in a curved surface to direct air around corners formed by the outer chamber and toward the heating units.

4. In combination, an axial flow fan plug unit and a heat treating furnace comprising, a furnace wall defining a chamber with an opening into the chamber accommodating the plug unit, said plug unit having a driven shaft, a housing surrounding said shaft, an impeller mounted on the shaft and having opposing faces, said impeller including a tankhead and a plurality of blades disposed about and extending radially from said tankhead, said blades positioned within the furnace chamber for circulating air thereabout, said furnace including a shroud defining an inner furnace chamber and an outer furnace chamber between the shroud and furnace wall, said shroud including an opening extending about said impeller, a deflector having a bugle bell shape and having a wall wherein the deflector wall is defined by a radius of curvature which initiates at a first end defining a minor radius and becomes tangent to and which terminates at a second end defining a major diameter, said deflector positioned about said housing and with the first end adjacent one of said opposing impeller faces and slightly spaced from said impeller so as to separate the fluid passing through the shroud opening and impeller blades into a first annular area between the deflector and the housing and a second annular area radially outward of the deflector, said minor diameter equal to twice the square root of $(r_1^2+r_3^2)/2$, wherein $r_1$ is the tankhead radius and $r_3$ is the shroud opening radius, so as to render the first and second areas equal, whereby the air curtain formed by the rotating blades is reduced and the efficiency of the fan is increased.

5. The combination of claim 4, said housing being frustoconical with a smaller diameter substantially equal to the diameter of the tankhead positioned coaxially thereto and adjacent the impeller.

6. The combination of claim 5 wherein the axial extent of the deflector terminates midway of the distance between the shroud and furnace wall dividing the outer chamber into equal areas of fluid exit.

7. The combination of claim 6 wherein the deflector terminates in a surface tangent to an imaginary plane bisecting the outer furnace chamber.

8. The combination of claims 4, 5, 6 or 7 including an extension plate mounted within the furnace in line with and substantially abutting the end of the deflector opposite the impeller to extend the annular flow areas substantially beyond the deflector.

* * * * *